US010587079B2

(12) United States Patent
Ba

(10) Patent No.: US 10,587,079 B2
(45) Date of Patent: Mar. 10, 2020

(54) ELECTRICAL CONNECTOR

(71) Applicant: LOTES CO., LTD, Keelung (TW)

(72) Inventor: Jin Ba, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/210,191

(22) Filed: Dec. 5, 2018

(65) Prior Publication Data

US 2019/0173238 A1 Jun. 6, 2019

Related U.S. Application Data

(60) Provisional application No. 62/595,176, filed on Dec. 6, 2017.

(30) Foreign Application Priority Data

Feb. 6, 2018 (CN) ..... 2018 1 0116699

(51) Int. Cl.

| | |
|---|---|
| ***H01R 13/648*** | (2006.01) |
| ***H01R 13/6594*** | (2011.01) |
| ***H01R 13/6585*** | (2011.01) |
| ***H01R 24/64*** | (2011.01) |
| ***H01R 13/6597*** | (2011.01) |

(Continued)

(52) U.S. Cl.

CPC ..... *H01R 13/6594* (2013.01); *H01R 13/639* (2013.01); *H01R 13/6585* (2013.01); *H01R 13/6597* (2013.01); *H01R 24/60* (2013.01); *H01R 24/64* (2013.01); *H01R 13/502* (2013.01); *H01R 2107/00* (2013.01)

(58) Field of Classification Search

CPC ..... H01R 13/6594; H01R 13/639; H01R 13/6585; H01R 13/502; H01R 24/60; H01R 24/64; H01R 2107/00

USPC ..... 439/607.08, 607.09, 607.11, 607.34, 439/607.35, 607.4

See application file for complete search history.

(56) References Cited

U.S. PATENT DOCUMENTS

| | | | | |
|---|---|---|---|---|
| 8,968,031 | B2 * | 3/2015 | Simmel | H01R 13/659 439/660 |
| 10,020,619 | B2 * | 7/2018 | Zhang | H01R 12/7082 |
| 10,122,124 | B2 * | 11/2018 | Daughtry, Jr. | H01R 13/405 |

FOREIGN PATENT DOCUMENTS

| | | |
|---|---|---|
| CN | 205452703 U | 8/2016 |
| CN | 205863479 U | 1/2017 |

(Continued)

*Primary Examiner* — Khiem M Nguyen

(74) *Attorney, Agent, or Firm* — Locke Lord LLP; Tim Tingkang Xia, Esq.

(57) ABSTRACT

An electrical connector includes an insulating body, a shielding sheet provided in the insulating body, at least one row of terminals accommodated in the insulating body and located on one side of the shielding sheet, a shielding shell sleeved outside the insulating body, and a first grounding portion. The terminals include at least one ground terminal. The shielding shell has an upper wall and a lower wall opposite to each other and two side walls connected to the upper wall and the lower wall. At least one of the side walls is provided with at least one elastic portion. The first grounding portion extends from the at least one ground terminal or from the shielding sheet toward a side thereof. The first grounding portion is provided with a cutting surface, which is exposed from the insulating body and elastically abuts an inner wall surface of the elastic portion.

21 Claims, 9 Drawing Sheets

(51) Int. Cl.

| | |
|---|---|
| ***H01R 13/639*** | (2006.01) |
| ***H01R 24/60*** | (2011.01) |
| *H01R 107/00* | (2006.01) |
| *H01R 13/502* | (2006.01) |

(56) References Cited

FOREIGN PATENT DOCUMENTS

| | | | |
|---|---|---|---|
| CN | 206461149 | U | 9/2017 |
| CN | 206461183 | U | 9/2017 |
| CN | 206541992 | U | 10/2017 |
| CN | 206595467 | U | 10/2017 |

* cited by examiner

100

100

ELECTRICAL CONNECTOR

CROSS-REFERENCE TO RELATED PATENT APPLICATION

This non-provisional application claims priority to and the benefit of, pursuant to 35 U.S.C. § 119(e), U.S. provisional patent application Ser. No. 62/595,176 filed Dec. 6, 2017 and under 35 U.S.C. § 119(a), patent application Serial No. CN201810116699.6 filed in China on Feb. 6, 2018. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector with good high frequency transmission properties.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

With the development of electronic technology, the speed and frequency of signal transmission are increasingly high. Therefore, requirements for the high frequency transmission of an electrical connector are high. An existing USB socket connector includes a shielding shell, an insulating body sleeved inside the shielding shell, and at least one ground terminal and a shielding sheet. The ground terminal and the shielding sheet are fixedly provided in the insulating body, and the shielding sheet is located at one side of the ground terminal. The ground terminal or the shielding sheet is provided with a grounding portion which laterally extends out of the insulating body. During assembly, the insulating body is assembled into the shielding shell from back to front. In order to reduce the electromagnetic interference of the USB socket connector, the grounding portion must exactly abut the inner side wall of the shielding shell so as to be in rigid contact with the inner side wall of the shielding shell. However, during production, some tolerances inevitably exist in the processing of the grounding portion. Therefore, the circumstance that the grounding portion cannot be in contact with the shielding shell easily arises, such that the terminal or the shielding sheet cannot be in rigid contact with the shielding shell and then cannot be grounded, causing the electromagnetic interference of the USB socket connector not to be reduced favorably, and thereby affecting the transmission of high frequency signals.

Therefore, it is necessary to design an improved electrical connector so as to overcome the foregoing problems.

SUMMARY

In view of the above problems in the background, the present invention is directed to an electrical connector with good high frequency transmission properties. By providing an elastic portion on a side wall of a shielding shell, a cutting surface of a ground terminal or a shielding sheet elastically abuts the elastic portion, thus achieving stable contact among the ground terminal, the shielding sheet and the shielding shell, and ensuring grounding.

In order to achieve the foregoing objective, the present invention adopts the following technical solutions:

An electrical connector includes: an insulating body; a shielding sheet provided in the insulating body; at least one row of terminals, accommodated in the insulating body, located on one side of the shielding sheet, and comprising at least one ground terminal; a shielding shell sleeved outside the insulating body and having an upper wall and a lower wall opposite to each other and two side walls connected to the upper wall and the lower wall respectively, wherein at least one of the two side walls is provided with at least one elastic portion; and a first grounding portion extending from the at least one ground terminal or from the shielding sheet toward a side thereof, wherein the first grounding portion is provided with a cutting surface, and the cutting surface is exposed from the insulating body and elastically abuts an inner wall surface of the at least one elastic portion.

In certain embodiments, at least one through slot is provided on at least one of the side walls, the through slot has a first slot wall and a second slot wall provided opposite to each other, the elastic portion is connected to the second slot wall and extends toward the first slot wall from the second slot wall, and a free end of the elastic portion is disconnected from the first slot wall.

In certain embodiments, the first slot wall and the second slot wall are provided opposite to each other in a front-rear direction.

In certain embodiments, the second slot wall is provided to be spaced apart from a rear edge of the lower wall.

In certain embodiments, a metal shell is sleeved on the shielding shell, and the metal shell covers the through slot and the elastic portion.

In certain embodiments, a side surface of the metal shell is provided with at least one first locking portion, and the side walls are correspondingly provided with at least one second locking portion configured to be matched with the at least one first locking portion; the second slot wall comprises an upper slot wall and a lower slot wall spaced apart from each other by the elastic portion; and a distance between the upper slot wall and the second locking portion is greater than a distance between the lower slot wall and the second locking portion.

In certain embodiments, a free end of the elastic portion is inclined toward a direction close to the first grounding portion.

In certain embodiments, the at least one row of terminals comprises at least two ground terminals provided in an upper row and a lower row, the shielding sheet is located between the ground terminals in the upper row and the lower row, each of the ground terminals in one row of the upper row and the lower row is provided with the first grounding portion, each of the ground terminals in the other row of the upper row and the lower row is provided with a second grounding portion, and the first grounding portion and the second grounding portion are in lap joint contact.

In certain embodiments, the first grounding portion comprises: a first extending section laterally extending from the ground terminal in the one row; and a second extending section bending backward and extending from the first extending section; the second grounding portion comprises: a bending section extending from the ground terminal in the other row of the upper row and the lower row toward the ground terminal in the one row of the upper row and the lower row; a third extending section laterally extending from the bending section; and a fourth extending section bending backward and extending from the third extending section; wherein the first extending section and the third extending section are in surface attachment contact with each other, and the second extending section and the fourth extending section are in surface attachment contact with each other.

In certain embodiments, the second extending section laterally extends to form a protruding portion, and the cutting surface is provided on the protruding portion and configured to be in contact with the inner wall surface of the elastic portion.

In certain embodiments, the first grounding portion is provided on the ground terminal, the shielding sheet comprises a plate body and at least one abutting portion extending from the plate body toward a side thereof, and the abutting portion is exposed from the insulating body and is in rigid contact with the side walls.

In certain embodiments, the first grounding portion and the abutting portion are provided on a same side of the insulating body, and a height of the abutting portion is different from a height of the first grounding portion in a vertical direction.

In certain embodiments, the insulating body comprises a base portion, the base portion is provided with a recess portion, and the first grounding portion and the abutting portion are located in the recess portion.

In certain embodiments, a side surface of the metal shell is provided with at least one first locking portion, at least one of the side walls is provided with a connecting portion and at least one second locking portion located behind the elastic portion, the second locking portion is configured to be matched with the first locking portion, the connecting portion is connected to the second locking portion and the elastic portion, and the abutting portion is in rigid contact with the connecting portion.

In certain embodiments, the first grounding portion is formed by extending from a plate body of the shielding sheet toward a side thereof, at least one abutting portion is formed by extending from the ground terminal toward a side thereof, and the abutting portion is exposed from the insulating body and is in rigid contact with the side walls.

An electrical connector includes: an insulating body; a plurality of terminals fixedly provided on the insulating body in an upper row and a lower row, and comprising at least one ground terminal; a shielding sheet embedded in the insulating body and located between the terminals in the upper row and the lower row; a shielding shell sleeved outside the insulating body and comprising two side walls in a lateral direction, wherein at least one of the two side walls is provided with at least one elastic portion, and the elastic portion has an elastic contact surface; and a first grounding portion extending from the at least one ground terminal or from the shielding sheet toward a side thereof, wherein the first grounding portion is exposed from the insulating body and abuts the elastic contact surface.

In certain embodiments, a side edge of the first grounding portion is a cutting surface, and the cutting surface abuts the elastic contact surface.

In certain embodiments, the at least one row of terminals comprises at least two ground terminals provided in an upper row and a lower row, the shielding sheet is located between the ground terminals in the upper row and the lower row, each of the ground terminals in one row of the upper row and the lower row is provided with the first grounding portion, each of the ground terminals in the other row of the upper row and the lower row is provided with a second grounding portion, and the first grounding portion and the second grounding portion are in lap joint contact.

In certain embodiments, the first grounding portion comprises: a first extending section laterally extending from the ground terminal in the one row; and a second extending section bending backward and extending from the first extending section; the second grounding portion comprises: a bending section extending from the ground terminal in the other row of the upper row and the lower row toward the ground terminal in the one row of the upper row and the lower row; a third extending section laterally extending from the bending section; and a fourth extending section bending backward and extending from the third extending section; wherein the first extending section and the third extending section are in surface attachment contact with each other, and the second extending section and the fourth extending section are in surface attachment contact with each other.

In certain embodiments, the second extending section laterally extends to form a protruding portion, and a cutting surface is provided on the protruding portion and configured to be in contact with an inner wall surface of the elastic portion.

In certain embodiments, the elastic portion is inclined toward a direction close to the first grounding portion.

In certain embodiments, at least one through slot is provided on at least one of the side walls, the through slot has a first slot wall and a second slot wall provided opposite to each other, the elastic portion is connected to the second slot wall and extends toward the first slot wall from the second slot wall, and a free end of the elastic portion is disconnected from the first slot wall.

In certain embodiments, a metal shell is sleeved on the shielding shell, and the metal shell covers the through slot and the elastic portion.

In certain embodiments, the first grounding portion is provided on the ground terminal, the shielding sheet comprises a plate body and at least one abutting portion extending from the plate body toward a side thereof, and the abutting portion is exposed from the insulating body and is in rigid contact with the side walls.

In certain embodiments, the insulating body comprises a base portion, the base portion is provided with a recess portion, and the first grounding portion and the abutting portion are located in the recess portion.

In certain embodiments, the first grounding portion and the abutting portion are provided on a same side of the insulating body, and a height of the abutting portion is different from a height of the first grounding portion in a vertical direction.

In certain embodiments, the first grounding portion is formed by extending from a plate body of the shielding sheet toward a side thereof, at least one abutting portion is formed by extending from the ground terminal toward a side thereof, and the abutting portion is exposed from the insulating body and is in rigid contact with the side walls.

Compared with the related art, certain embodiments of the present invention have the following beneficial effects. The first grounding portions extend from the ground terminal or from the shielding sheet toward a side thereof. The first grounding portion is provided with a cutting surface, which is exposed from the insulating body. The shielding shell is provided with the side walls, and the side walls are provided with elastic portion. The cutting surface elastically abuts an inner wall surface of the elastic portion. The first grounding portion can be formed by a stamping process, and the elastic portion can also be formed by a stamping process, thus reducing the steps of the manufacturing process and facilitating easy forming. Further, the first grounding portion does not require to be elastic, and the elastic portion is guaranteed to have enough elasticity to implement contact and ensure grounding. Moreover, under the circumstance that processing tolerances exist, it is ensured that the first grounding portion elastically abuts the elastic portion, thereby ensuring grounding. Compared with the case where the first grounding portion and the side walls are in rigid contact, in the present invention, the abutting force of the first grounding portion to the elastic portion is large, and the first grounding portion is in contact with the elastic portion tightly.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
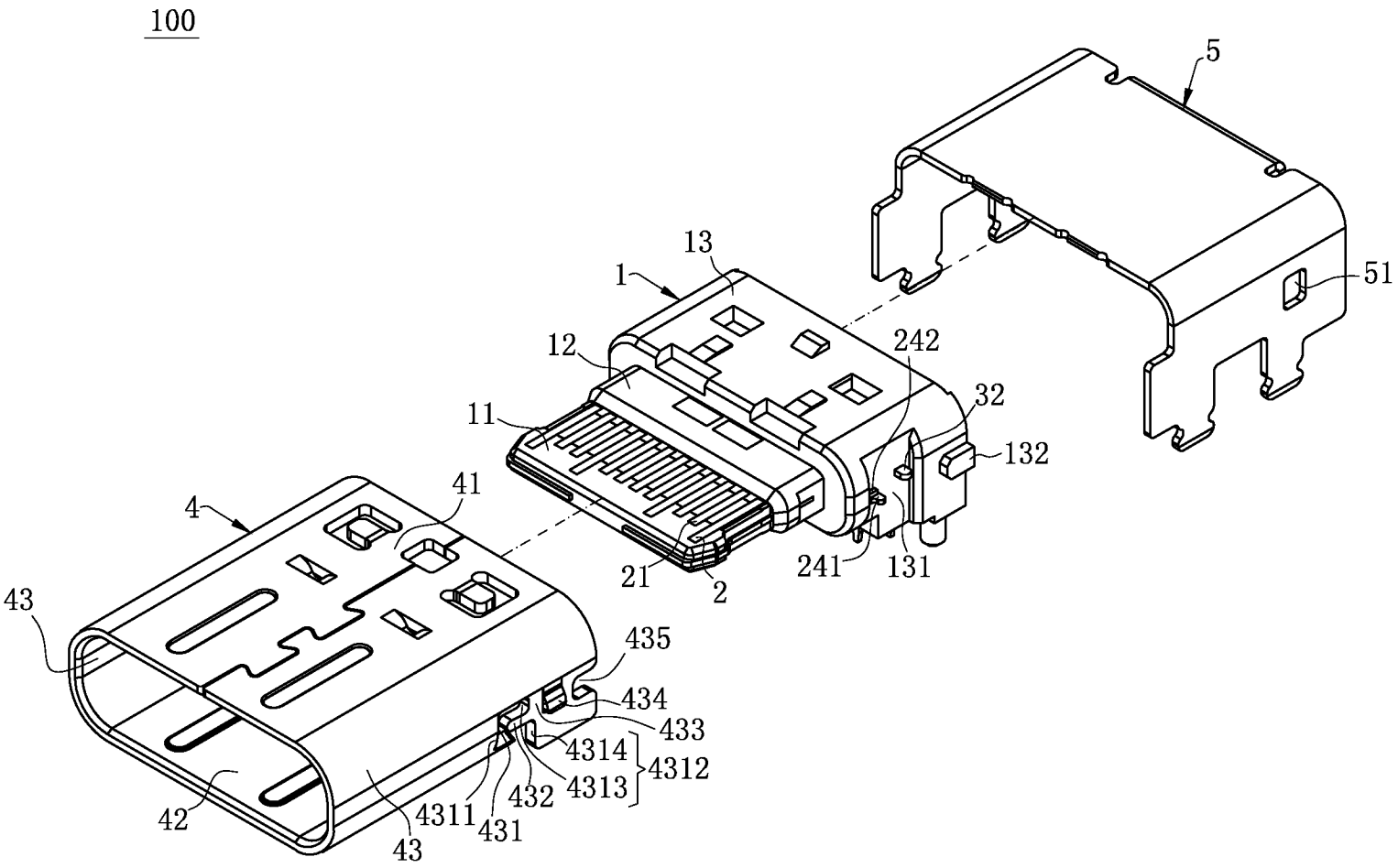
FIG. 1 is a local exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-9. In accordance with the purposes of this invention, as embodied and broadly described herein, this invention, in one aspect, relates to an electrical connector.

Figure 2:
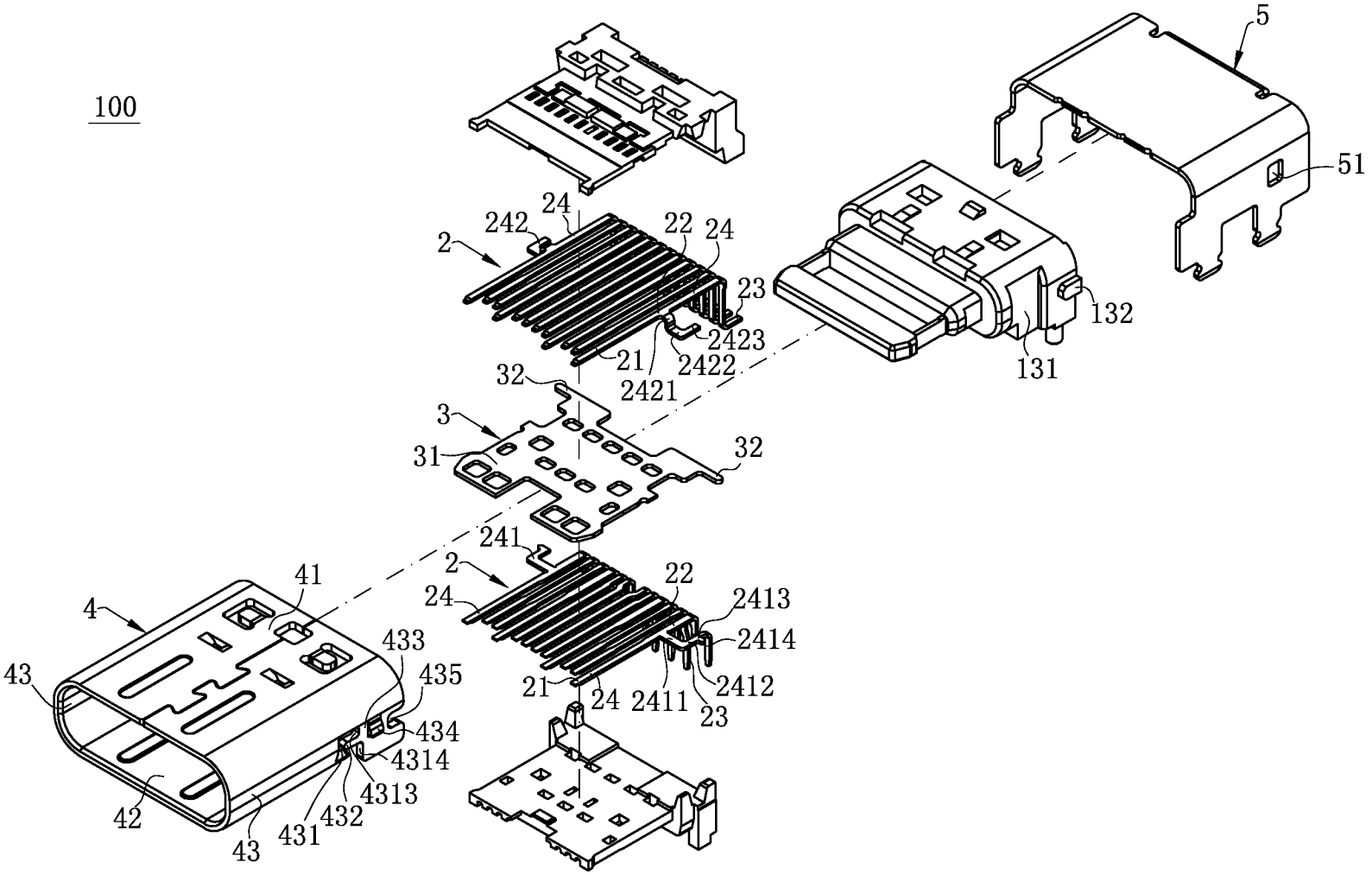
FIG. 2 is a perspective exploded view of FIG. 1.

As shown in FIG. 1 and FIG. 2, an electrical connector 100 of the present invention includes an insulating body 1, two rows of terminals 2, a shielding sheet 3, a shielding shell 4 and a metal shell 5. The shielding sheet 3 is located between the two rows of terminals 2, and the shielding sheet 3 and the two rows of terminals are fixedly provided in the insulating body 1 together. The shielding shell 4 is sleeved on the insulating body 1, and the metal shell 5 covers the shielding shell 4.

Figure 7:
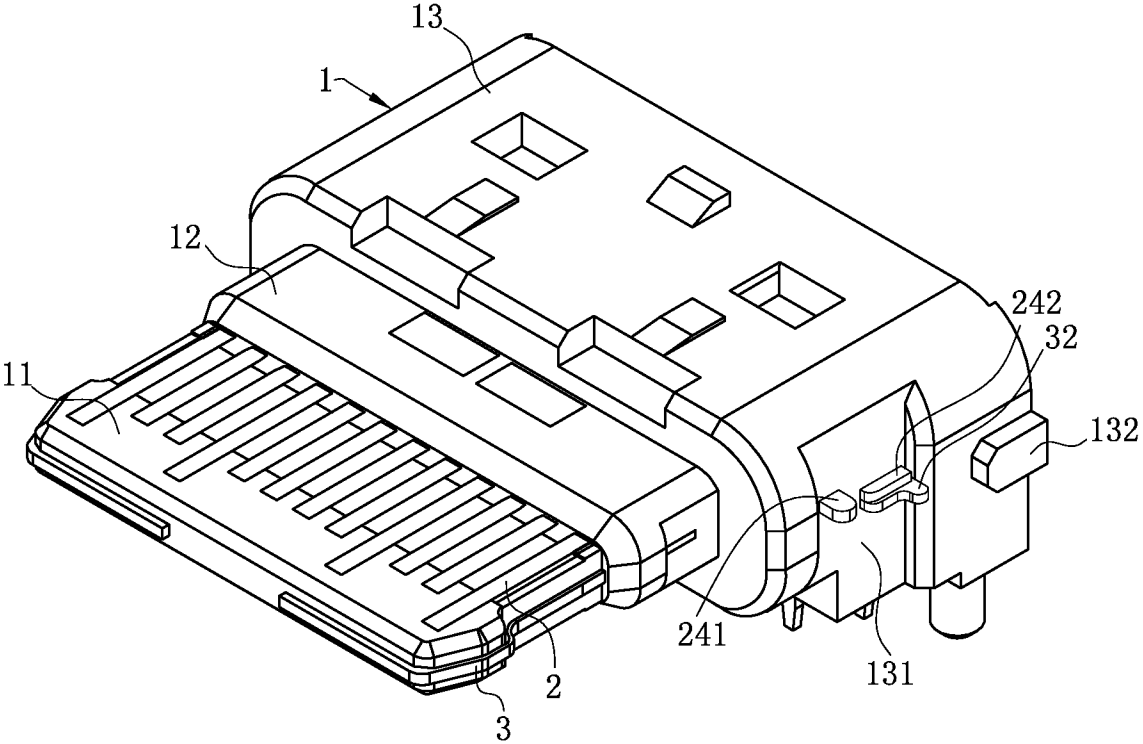
FIG. 7 is a perspective schematic view of the electrical connector according to a second embodiment of the present invention.

As shown in FIG. 1, FIG. 2 and FIG. 7, according to a first embodiment of the present invention, the insulating body 1 has a base portion 13 and a tongue 11 extending forward from the base portion 13. A step portion 12 is formed at a connecting location of the tongue 11 with the base portion 13. Two sides of the base portion 13 are concavely provided with two recess portions 131 respectively. Two sides of a rear end of the base portion 13 are provided with two fixing blocks 132 respectively extending forward from a rear edge of the base portion 13, and each fixing block 132 is located behind the corresponding recess portion 131. The shielding shell 4 has an upper wall 41 and a lower wall 42 opposite to each other, and two side walls 43 connected with the upper wall 41 and the lower wall 42. The upper wall 41, the lower wall 42, the two side walls 43 and the tongue 11 jointly define an accommodating cavity 44 therein surroundingly, and the accommodating cavity 44 is configured to be mated with a mating connector (not shown, same hereinafter).

Figure 3:
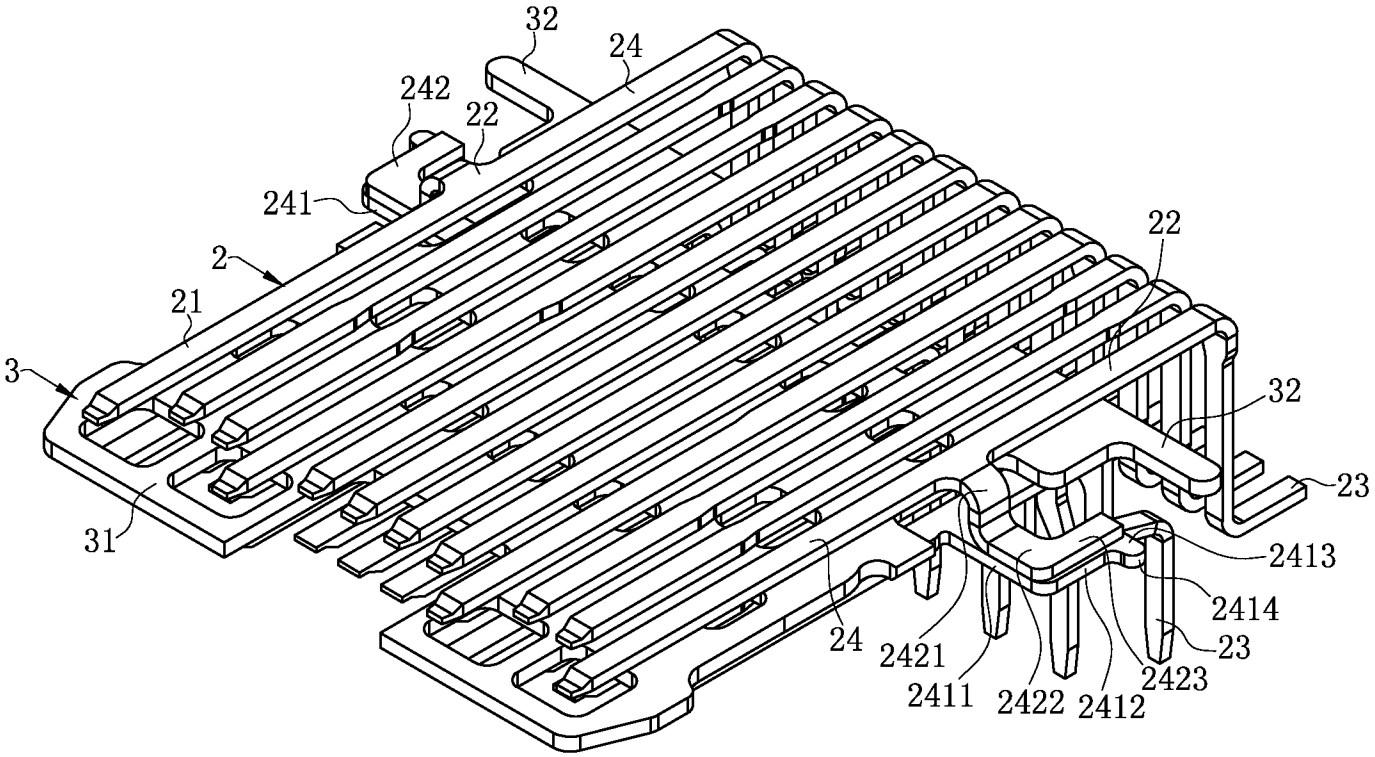
FIG. 3 is a perspective assembled view of terminals and a shielding sheet in FIG. 2.
Figure 5:
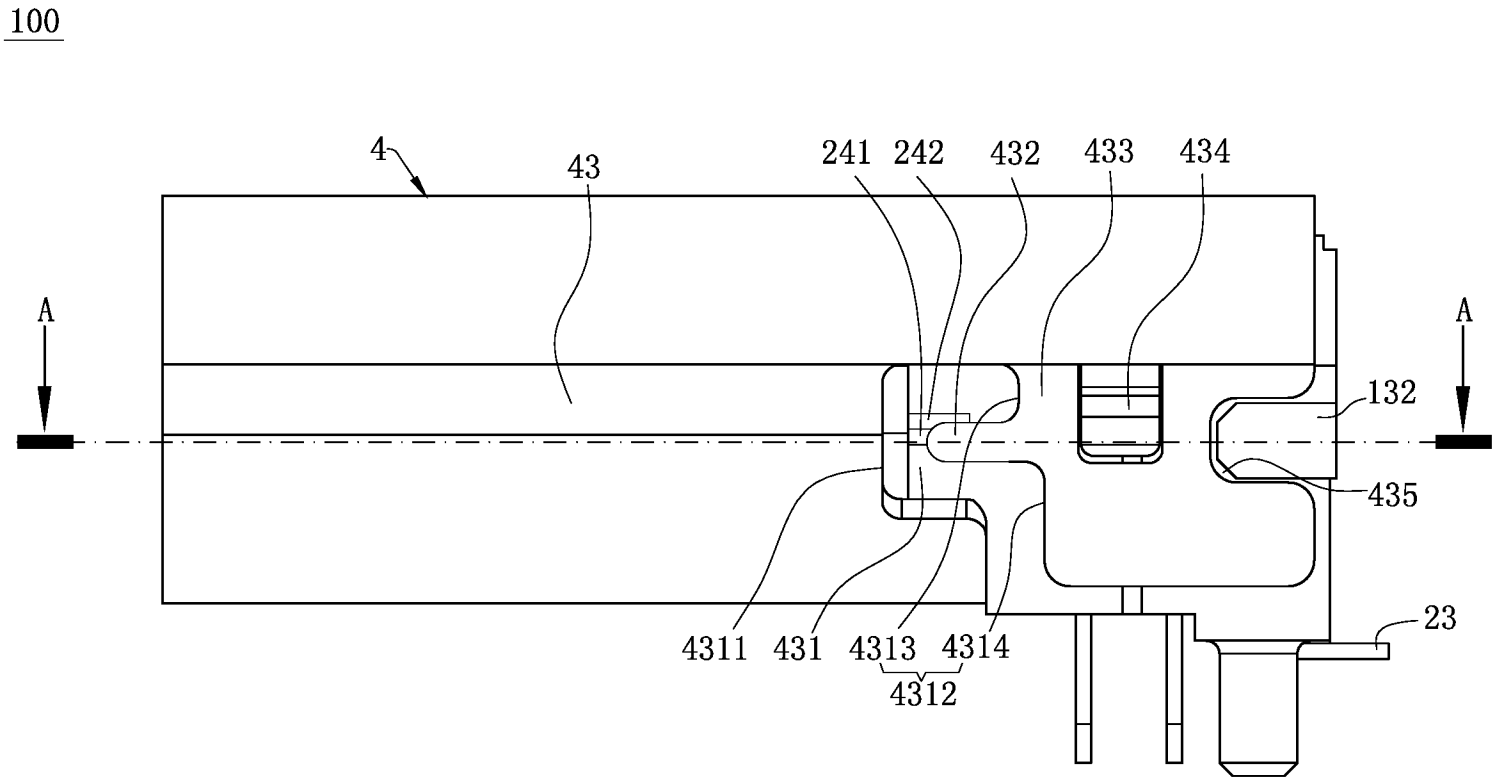
FIG. 5 is a side view of the electrical connector according to the first embodiment of the present invention.

As shown in FIG. 2, FIG. 3 and FIG. 5, according to the first embodiment of the present invention, each terminal 2 has a fixing portion 22. The fixing portion 22 is embedded in the base portion 13 and the step portion 12, and the fixing portion 22 extends forward to form a contact portion 21. The contact portion 21 is exposed from the tongue 11, and the fixing portion 22 extends backward to form a soldering portion 23.

The soldering portion 23 extends out of the base portion 13 and is configured to be conductively connected with a circuit board (not shown). The two rows of terminals 2 include multiple signal terminals (not labeled), multiple power terminals (not labeled) and multiple ground terminals 24. The ground terminals 24 are respectively located at the outermost sides of the different rows of terminals 2. A first grounding portion 241 extends from the fixing portion 22 of each ground terminal 24 in the lower row toward a side thereof, and a second grounding portion 242 extends from the fixing portion 22 of each ground terminal 24 in the upper row toward a side thereof. Further, the first grounding portion 241 of each ground terminal 24 in the lower row includes a first extending section 2411 laterally extending from the ground terminal 24 in the lower row, and a second extending section 2412 bending backward and extending from the first extending section 2411. The second extending section 2412 partially extends out of the base portion 13. A protruding portion 2413 further extends from a free end of each second extending section 2412 toward a side thereof. A side edge of the protruding portion 2413 is a cutting surface 2414 which protrudes out of the base portion 13.

Correspondingly, the second grounding portion 242 of each ground terminal 24 in the upper row includes a bending section 2421 bends and extends from each ground terminal 24 in the upper row toward the first extending section 2411 in the lower row. A third extending section 2422 laterally extends from the corresponding bending section 2421, and a fourth extending section 2423 bends backward from the third extending section 2422. The first grounding portion 241 and the second grounding portion 242 are in lap joint contact, such that the first extending section 2411 and the third extending section 2422 are in surface attachment contact with each other, and the second extending sections 2412 and the fourth extending section 2423 are in surface attachment contact with each other. The first grounding portion 241 and the second grounding portion 242 can be in contact stably without soldering. Of course, in other embodiments, the first grounding portion 241 and the second grounding portion 242 can be soldered together.

Figure 4:
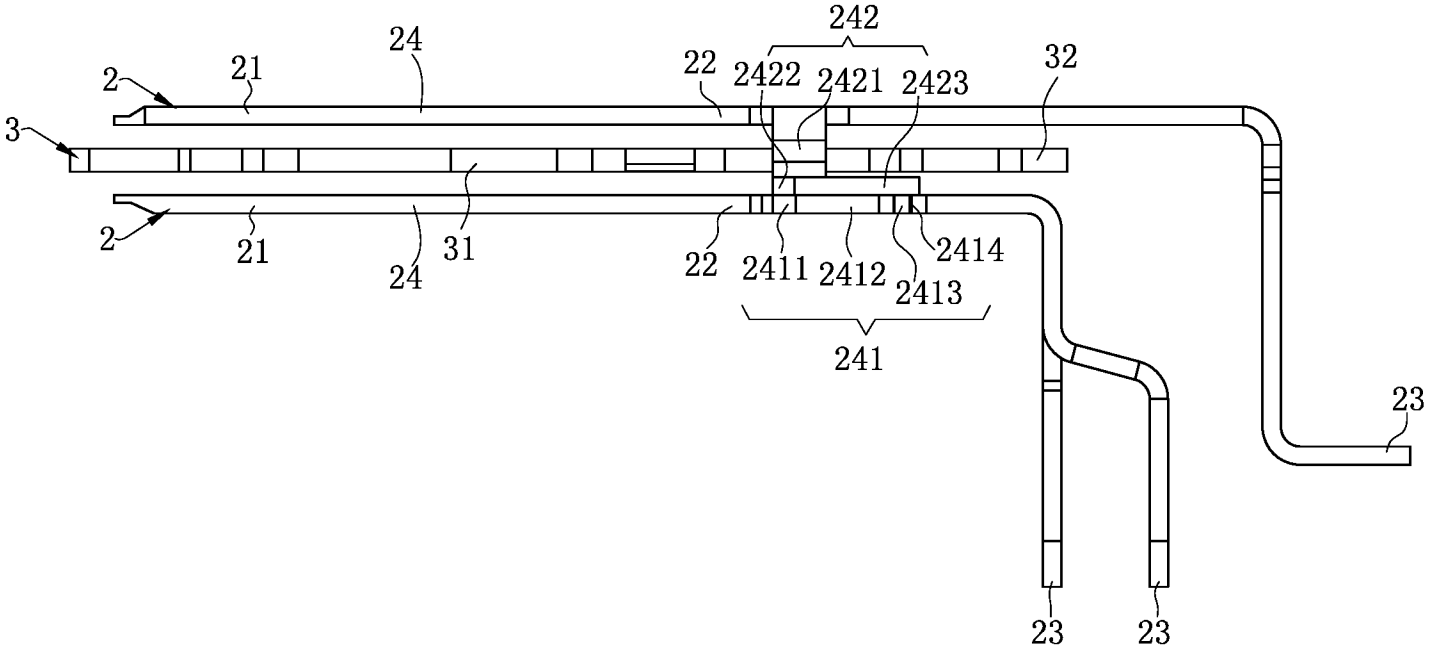
FIG. 4 is a side view of FIG. 3.

As shown in FIG. 2, FIG. 4 and FIG. 5, the shielding sheet 3 includes a plate body 31 and two abutting portions 32 laterally extending from a rear end of the plate body 31. The abutting portions 32 protrude out of the base portion 13. One side of the insulating body 1 is provided with the first grounding portion 241, the second grounding portion 242 and the abutting portions 32, and the other side of the insulating body 1 is also provided with the first grounding portion 241, the second grounding portion 242 and the abutting portions 32. The abutting portions 32 are located behind the first grounding portions 241 and the second grounding portions 242, and are higher than the first grounding portions 241 and the second grounding portions 242. Of course, in other embodiments, the lower row of terminals 2 can bend and extend toward the third extending sections 2422 to form the bending sections 2421, or a free end of the fourth extending section 2423 laterally extends out to form the protruding portion 2413 toward a side thereof, or the first grounding portions 241 and the second grounding portions 242 are higher than the abutting portions 32. When the insulating body 1 is assembled into the shielding shell 4 from back to front, the first grounding portions 241 and the abutting portions 32 enter the shielding shell 4 successively along the side walls 43. Because the heights of the first grounding portions 241 are different from the heights of the abutting portions 32 in the vertical direction, the side walls 43 can be prevented from being repeatedly scratched twice, and abrasion on the shielding shell 4 is reduced. Further, when the insulating body 1 is assembled into the shielding shell 4, the interference force is relatively small, and thus the insulating body 1 is assembled into the shielding shell 4 more easily. Moreover, in the present embodiment, the bending sections 2421 are only formed on the second grounding portions 242. Compared with the case where the bending sections 2421 are formed on both the first grounding portions 241 and the second grounding portions 242, the forming process on the ground terminals 24 in the lower row can be reduced, and the manufacturing precision is improved. The first grounding portions 241 can be formed by stamping at one time, with few manufacturing procedures, and easy formation.

Figure 6:
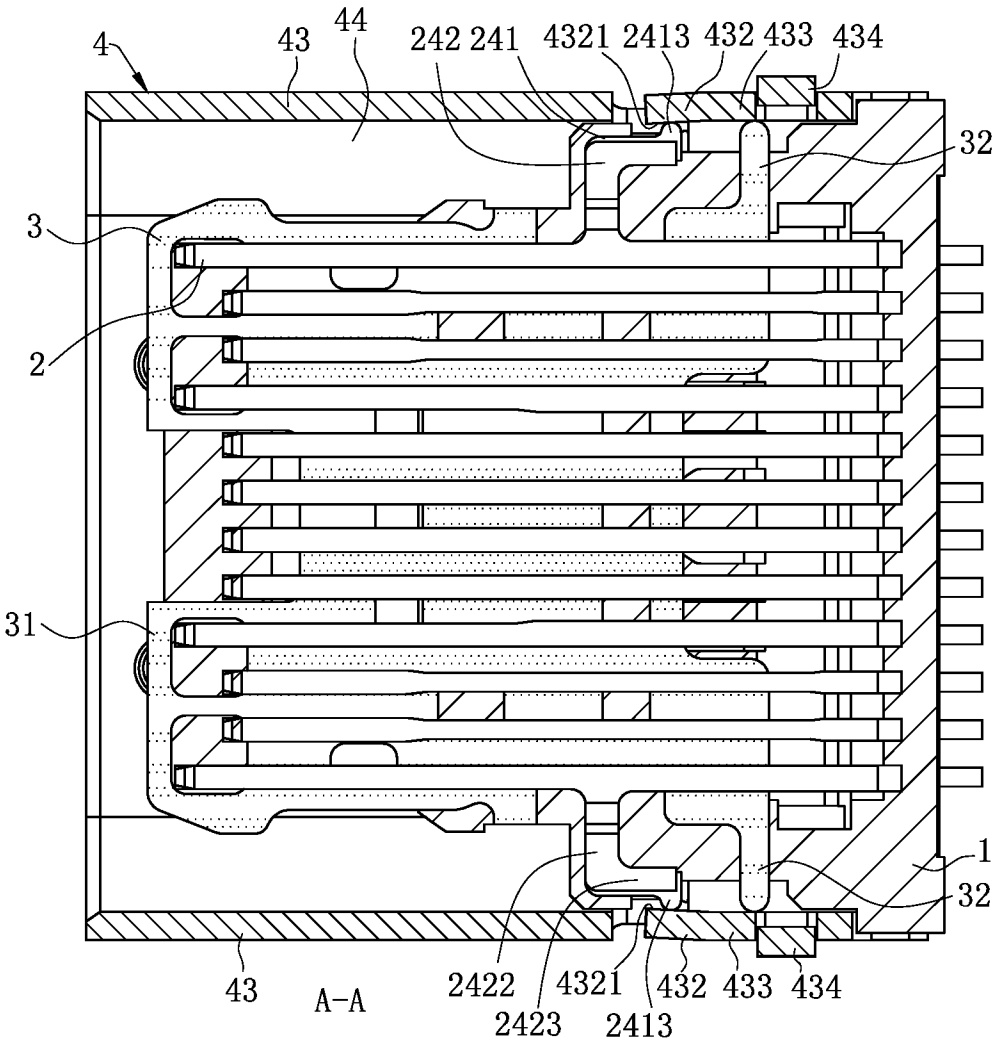
FIG. 6 is a sectional view along an A-A direction of FIG. 5.

As shown in FIG. 2, FIG. 5 and FIG. 6, the two side walls 43 are respectively provided with two through slots 431. Each through slot 431 has a first slot wall 4311 and a second slot wall 4312 provided opposite to each other in a front-rear direction, and the second slot wall 4312 extends forward to form an elastic portion 432. The elastic portion 432 divides the second slot wall 4312 into an upper slot wall 4313 and a lower slot wall 4314. The lower slot wall 4314 is spaced apart from a rear edge of the lower wall 42. Thus, difficulty of stamping on the shielding shell 4 can be reduced. During the assembly process, the insulating body 1 is assembled into the shielding shell 4 from back to front, and the first grounding portion 241 can elastically abut the corresponding elastic portion 432 in an assembling direction from back to front. A free end of the elastic portion 432 is disconnected from the first slot wall 4311 so as to ensure that the elastic portion 432 has elasticity. The elastic portion 432 has an elastic contact surface 4321, and the elastic contact surface 4321 is the inner wall surface of the elastic portion 432. The free end of the elastic portion 432 is inclined toward a direction close to the first grounding portion 241. During assembling, the first grounding portion 241 enters the shielding shell 4 along the elastic portion 432, and pushes the elastic portions 432 outward. Eventually, the free end of the elastic portion 432 is still inclined toward the direction close to the first grounding portion 241, avoiding the circumstance that the elastic portion 432 scratches the mating connector when the electrical connector 100 is mated with the mating connector, and ensuring enough elasticity of the elastic portion 432. Thus, the cutting surface 2415 of the first grounding portion 241 can be in close contact with the elastic contact surface 4321. The first grounding portion 241 does not require to be elastic, as the elastic portion 432 is guaranteed to have enough elasticity. Under the circumstance that processing tolerances exist, it is ensured that the first grounding portion 241 elastically abuts the elastic portion 432, thereby ensuring grounding. Compared with the case where the first grounding portion 241 and the side walls 43 are in rigid contact, in the present invention, the abutting force of the first grounding portion 241 to the elastic portion 432 is large, and the first grounding portion 241 is in contact with the elastic portion 432 tightly.

As shown in FIG. 1, FIG. 2 and FIG. 6, the first grounding portions 241, the second grounding portions 242 and the abutting portions 32 are all located in the recess portion 131. By providing the recess portion 131, the elastic portion 432 can move toward the recess portion 131, thus ensuring that the elastic portion 432 has certain elastic deformation space. If the base portion 13 is not provided with the recess portion 131, the first grounding portions 241 have to be provided longer to ensure that the elastic portion 432 can abut the first grounding portions 241. Therefore, the recess portion 131 can also have the effect of reducing materials for making the insulating body 1 and the first grounding portions 241, decreasing the length of each first grounding portion 241, and then reducing the overall size of the electrical connector 100.

As shown in FIG. 1, FIG. 2 and FIG. 5, the rear ends of the side walls 43 are respectively provided with two fixing grooves 435 concavely formed forward from the rear edges of the side walls 43. The edges of the fixing grooves 435 are matched with the outlines of the fixing blocks 132. When the insulating body 1 is assembled into the shielding shell 4 from back to front, the fixing blocks 132 can enter the fixing grooves 435 in the assembling direction, such that the insulating body 1 can be smoothly fixed in the shielding shell 4. Of course, in other embodiments, the number of the fixing blocks 132 and the number of the fixing grooves 435 can be multiple, and the outlines of the fixing blocks 132 can be different from the outlines of the fixing grooves 435.

As shown in FIG. 1 and FIG. 2, each of the two side walls 43 is torn outward to form a second locking portion 434. The second locking portions 434 are located behind the elastic portions 432. Correspondingly, the metal shell 5 is provided with two first locking portions 51, and the first locking portions 51 are open and are configured to accommodate the second locking portions 434. By matching the first locking portions 51 with the second locking portions 434, the shielding shell 4 and the metal shell 5 are fixed. Of course, in other embodiments, the number of the first locking portions 51 and the number of the second locking portions 434 can be one or multiple, and the locations where the first locking portions 51 and the second locking portions 434 are provided can also be different. The metal shell 5 covers the through slots 431 and the elastic portion 432, ensuring that under the circumstance of improper assembling, the first grounding portions 241 or the abutting portions 32 abut the metal shell 5 while extending out of the through slots 431, thus ensuring grounding, and further enhancing the shielding effect of the electrical connector 100.

As shown in FIG. 2, FIG. 5 and FIG. 6, each side wall 43 is provided with a connecting portion 433 which is configured to be connected to the corresponding second locking portion 434 and the elastic portion 432. The abutting portions 32 are in rigid contact with the connecting portions 433. Because the side edges of the cutting surfaces 2415 and the side edges of the abutting portions 32 are arc-shaped surfaces, the first grounding portions 241 are in point contact with the elastic contact surfaces 4321, and the abutting portions 32 are also in point contact with the connecting portions 433. The pre-pressure of the first grounding portions 241 to the elastic contact surfaces 4321 and the pre-pressure of the abutting portions 32 to the connecting portions 433 are large. Thus, the contact effect is good. A distance between each upper slot wall 4313 and the corresponding second locking portion 434 is greater than a distance between each lower slot wall 4314 and the corresponding second locking portion 434. That is, in a front-rear direction, the lower slot walls 4314 are located behind the upper slot walls 4313. The lower edge of the elastic portion 432 is longer than the upper edge of the elastic portion 432, such that the elasticity of the elastic portion 432 is strengthened. Further, the connecting portions 433 have enough area to ensure the strength of the connecting portions 433, and to further ensure that the abutting portions 32 are in rigid contact with the connecting portions 433.

Figure 8:
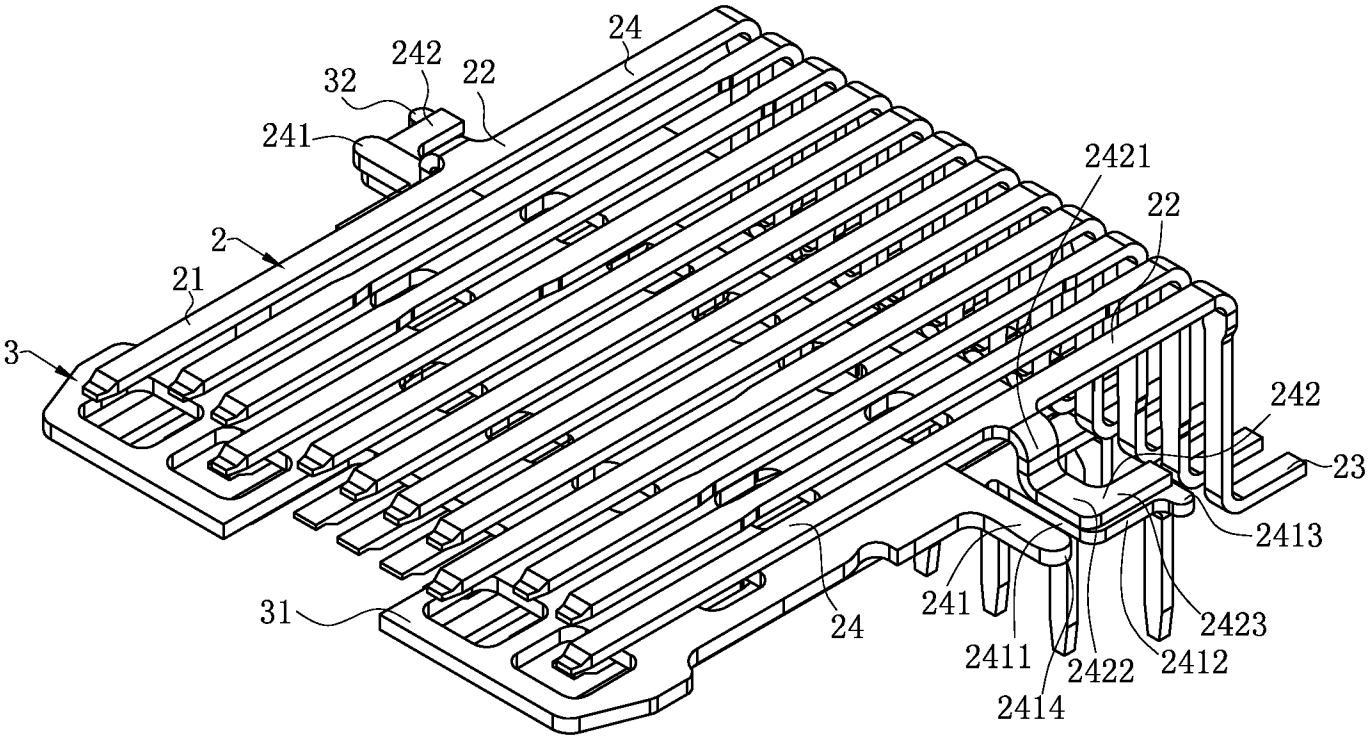
FIG. 8 is a perspective assembled view of the terminals and the shielding sheet in FIG. 7.
Figure 9:
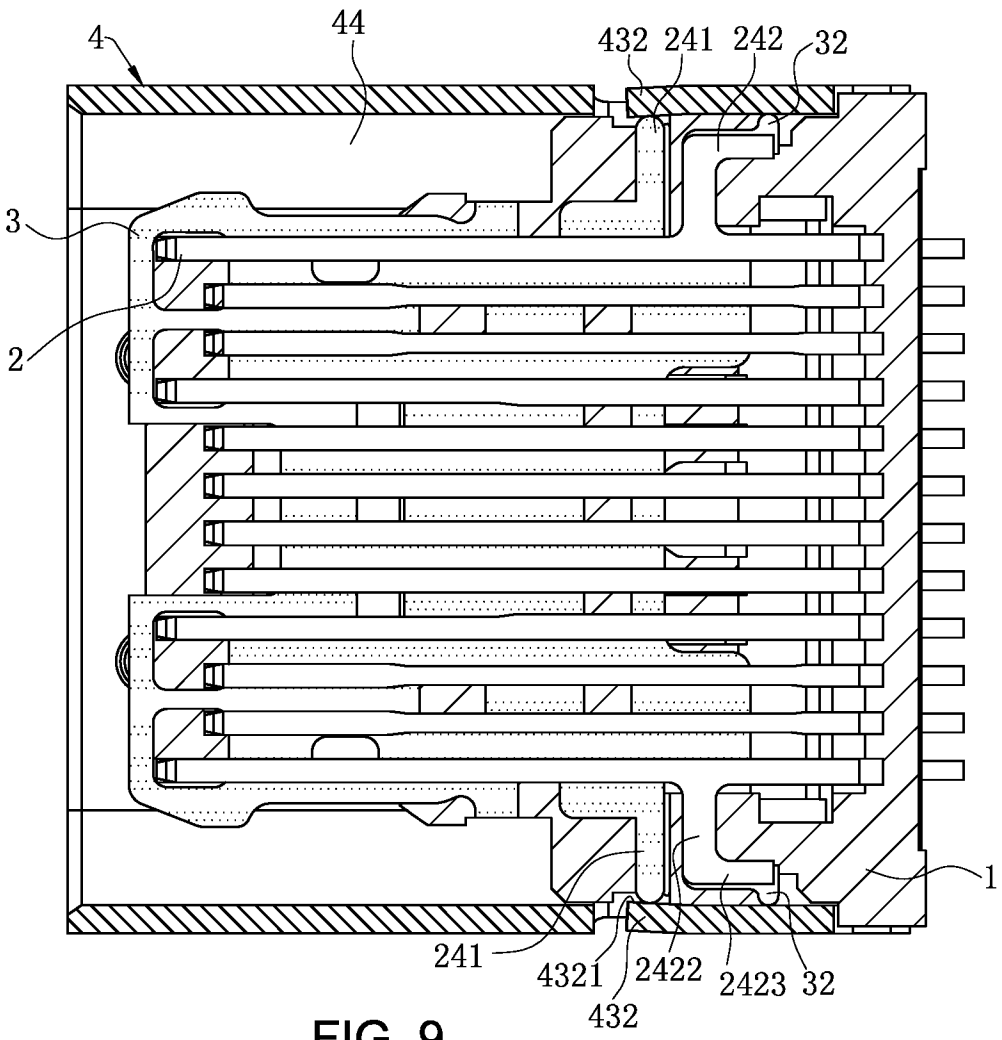
FIG. 9 is a sectional view of the electrical connector according to the second embodiment of the present invention.

FIG. 7, FIG. 8 and FIG. 9 show a second embodiment of the present invention. The differences of this embodiment from the first embodiment exist in that: each first grounding portion 241 is formed by extending from the plate body 31 toward the side thereof, and the cutting surface 2415 is provided at the side edge of each first grounding portion 241 and is in elastic contact with the corresponding elastic contact surface 4321. The abutting portions 32 are provided on the ground terminals 24 in the lower row, and each abutting portion 32 further includes the first extending section 2411 laterally extending from the ground terminal 24 in the lower row and the second extending section 2412 bending backward and extending from the first extending section 2411. The free end of the second extending section 2412 further extends toward a side thereof to form a protruding portion 2413. Each protruding portion 2413 is in rigid contact with the corresponding connecting portion 433. Correspondingly, the second grounding portions 242 are provided in the ground terminals 24 in the upper row, and the second grounding portion 242 of each ground terminal 24 in the upper row bends and extends toward the first extending section 2411 to form the bending section 2421, the bending section 2421 laterally extends to form the third extending section 2422, and the third extending sections 2422 bends backward to form the fourth extending section 2423. Of course, in other embodiments, the protruding portions 2413 can be provided on the second extending sections 2412. Alternatively, the protruding portions 2413 are respectively provided on the second extending sections 2412 and the fourth extending sections 2423. Alternatively, the abutting portions 32 are only provided with the first extending sections 2411 laterally extending, the second grounding portions 242 are only provided with the third extending sections 2422 laterally extending, and the first extending sections 2411 and the third extending sections 2422 abut the connecting portions 433.

To sum up, the electrical connector 100 according to certain embodiments of the present invention has the following beneficial effects:

(1) The first grounding portions 241 and the abutting portions 32 are respectively provided at two sides of the insulating body 1. The abutting portions 32 are located behind the first grounding portions 241, and are higher than the first grounding portions 241. When the insulating body 1 is assembled into the shielding shell 4 from back to front, the first grounding portions 241 and the abutting portions 32 enter the shielding shell 4 successively along the side walls 43. Because the heights of the first grounding portions 241 are different from the heights of the abutting portions 32 in the vertical direction, the side walls 43 can be prevented from being repeatedly scratched twice, and abrasion on the shielding shell 4 is reduced. Further, when the insulating body 1 is assembled into the shielding shell 4, the interference force is relatively small, and thus the insulating body 1 is assembled into the shielding shell 4 more easily.

(2) In the present embodiment, the bending sections 2421 are only formed on the second grounding portions 242. Compared with the case where the bending sections 2421 are formed on the first grounding portions 241 and the second grounding portions 242, the forming process on the ground terminals 24 in the lower row can be reduced, and the manufacturing precision is improved. The first grounding portions 241 can be formed by a stamping process, and the elastic portions 432 can also be formed by a stamping process, with few manufacturing procedures, and easy formation.

(3) The free end of the elastic portion 432 is inclined toward a direction close to the first grounding portion 241. During assembling, the first grounding portion 241 enters the shielding shell 4 along the elastic portion 432, and pushes the elastic portions 432 outward. Eventually, the free end of the elastic portion 432 is still inclined toward the direction close to the first grounding portion 241, avoiding the circumstance that the elastic portion 432 scratches the mating connector when the electrical connector 100 is mated with the mating connector, and ensuring enough elasticity of the elastic portion 432. Thus, the cutting surface 2415 of the first grounding portion 241 can be in close contact with the elastic contact surface 4321. The first grounding portion 241 does not require to be elastic, as the elastic portion 432 is guaranteed to have enough elasticity. Under the circumstance that processing tolerances exist, it is ensured that the first grounding portion 241 elastically abuts the elastic portion 432, thereby ensuring grounding. Compared with the case where the first grounding portion 241 and the side walls 43 are in rigid contact, in the present invention, the abutting force of the first grounding portion 241 to the elastic portion 432 is large, and the first grounding portion 241 is in contact with the elastic portion 432 tightly.

(4) The first grounding portions 241, the second grounding portions 242 and the abutting portions 32 are all located in the recess portion 131. By providing the recess portion 131, the elastic portion 432 can move toward the recess portion 131, thus ensuring that the elastic portion 432 has certain elastic deformation space. If the base portion 13 is not provided with the recess portion 131, the first grounding portions 241 have to be provided longer to ensure that the elastic portion 432 can abut the first grounding portions 241. Therefore, the recess portion 131 can also have the effect of reducing materials for making the insulating body 1 and the first grounding portions 241, decreasing the length of each first grounding portion 241, and then reducing the overall size of the electrical connector 100.

(5) The metal shell 5 covers the through slots 431 and the elastic portion 432, ensuring that under the circumstance of improper assembling, the first grounding portions 241 or the abutting portions 32 abut the metal shell 5 while extending out of the through slots 431, thus ensuring grounding, and further enhancing the shielding effect of the electrical connector 100.

(6) The abutting portions 32 are in rigid contact with the connecting portions 433. The first grounding portions 241 are in point contact with the elastic contact surfaces 4321, and the abutting portions 32 are also in point contact with the connecting portions 433. The pre-pressure of the first grounding portions 241 to the elastic contact surfaces 4321 and the pre-pressure of the abutting portions 32 to the connecting portions 433 are large. Thus, the contact effect is good.

(7) A distance between each upper slot wall 4313 and the corresponding second locking portion 434 is greater than a distance between each lower slot wall 4314 and the corresponding second locking portion 434. That is, in a front-rear direction, the lower slot walls 4314 are located behind the upper slot walls 4313. The lower edge of the elastic portion 432 is longer than the upper edge of the elastic portion 432, such that the elasticity of the elastic portion 432 is strengthened. Further, the connecting portions 433 have enough area to ensure the strength of the connecting portions 433, and to further ensure that the abutting portions 32 are in rigid contact with the connecting portions 433.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector comprising:

an insulating body;

a shielding sheet provided in the insulating body;

a plurality of terminals, accommodated in the insulating body and provided in an upper row and a lower row, and comprising at least two ground terminals provided in the upper row and the lower row, wherein the shielding sheet is located between the ground terminals in the upper row and the lower row, each of the ground terminals in one row of the upper row and the lower row is provided with a first grounding portion, each of the ground terminals in the other row of the upper row and the lower row is provided with a second grounding portion, and the first grounding portion and the second grounding portion are in lap joint contact; and a shielding shell sleeved outside the insulating body and having an upper wall and a lower wall opposite to each other and two side walls connected to the upper wall and the lower wall respectively, wherein at least one of the two side walls is provided with at least one elastic portion;

wherein the first grounding portion is provided with a cutting surface, and the cutting surface is exposed from the insulating body and elastically abuts an inner wall surface of the at least one elastic portion, wherein the first grounding portion comprises:

a first extending section laterally extending from the ground terminal in the one row; and a second extending section bending backward and extending from the first extending section;

wherein the second grounding portion comprises:

a bending section extending from the ground terminal in the other row of the upper row and the lower row toward the ground terminal in the one row of the upper row and the lower row;

a third extending section laterally extending from the bending section; and a fourth extending section bending backward and extending from the third extending section;

wherein the first extending section and the third extending section are in surface attachment contact with each other, and the second extending section and the fourth extending section are in surface attachment contact with each other.

2. The electrical connector according to claim 1, wherein at least one through slot is provided on at least one of the side walls, the through slot has a first slot wall and a second slot wall provided opposite to each other, the elastic portion is connected to the second slot wall and extends toward the first slot wall from the second slot wall, and a free end of the elastic portion is disconnected from the first slot wall.

3. The electrical connector according to claim 2, wherein the first slot wall and the second slot wall are provided opposite to each other in a front-rear direction.

4. The electrical connector according to claim 2, wherein the second slot wall is provided to be spaced apart from a rear edge of the lower wall.

5. The electrical connector according to claim 2, wherein a metal shell is sleeved on the shielding shell, and the metal shell covers the through slot and the elastic portion.

6. The electrical connector according to claim 5, wherein:

a side surface of the metal shell is provided with at least one first locking portion, and the side walls are correspondingly provided with at least one second locking portion configured to be matched with the at least one first locking portion;

the second slot wall comprises an upper slot wall and a lower slot wall spaced apart from each other by the elastic portion; and a distance between the upper slot wall and the second locking portion is greater than a distance between the lower slot wall and the second locking portion.

7. The electrical connector according to claim 1, wherein a free end of the elastic portion is inclined toward a direction close to the first grounding portion.

8. The electrical connector according to claim 1, wherein the second extending section laterally extends to form a protruding portion, and the cutting surface is provided on the protruding portion and configured to be in contact with the inner wall surface of the elastic portion.

9. The electrical connector according to claim 1, wherein the shielding sheet comprises a plate body and at least one abutting portion extending from the plate body toward a side thereof, and the abutting portion is exposed from the insulating body and is in rigid contact with the side walls.

10. The electrical connector according to claim 9, wherein the first grounding portion and the abutting portion are provided on a same side of the insulating body, and a height of the abutting portion is different from a height of the first grounding portion in a vertical direction.

11. The electrical connector according to claim 9, wherein the insulating body comprises a base portion, the base portion is provided with a recess portion, and the first grounding portion and the abutting portion are located in the recess portion.

12. The electrical connector according to claim 9, wherein a side surface of the metal shell is provided with at least one first locking portion, at least one of the side walls is provided with a connecting portion and at least one second locking portion located behind the elastic portion, the second locking portion is configured to be matched with the first locking portion, the connecting portion is connected to the second locking portion and the elastic portion, and the abutting portion is in rigid contact with the connecting portion.

13. An electrical connector, comprising:

an insulating body;

a plurality of terminals fixedly provided on the insulating body in an upper row and a lower row, and comprising at least two ground terminals provided in the upper row and the lower row, wherein each of the ground terminals in one row of the upper row and the lower row is provided with a first grounding portion, each of the ground terminals in the other row of the upper row and the lower row is provided with a second grounding portion, and the first grounding portion and the second grounding portion are in lap joint contact;

a shielding sheet embedded in the insulating body and located between the ground terminals in the upper row and the lower row; and a shielding shell sleeved outside the insulating body and comprising two side walls in a lateral direction, wherein at least one of the two side walls is provided with at least one elastic portion, and the elastic portion has an elastic contact surface;

wherein the first grounding portion is exposed from the insulating body and abuts the elastic contact surface, wherein the first grounding portion comprises:

a first extending section laterally extending from the ground terminal in the one row; and a second extending section bending backward and extending from the first extending section;

wherein the second grounding portion comprises:

a bending section extending from the ground terminal in the other row of the upper row and the lower row toward the ground terminal in the one row of the upper row and the lower row;

a third extending section laterally extending from the bending section; and a fourth extending section bending backward and extending from the third extending section;

wherein the first extending section and the third extending section are in surface attachment contact with each other, and the second extending section and the fourth extending section are in surface attachment contact with each other.

14. The electrical connector according to claim 13, wherein a side edge of the first grounding portion is a cutting surface, and the cutting surface abuts the elastic contact surface.

15. The electrical connector according to claim 13, wherein the second extending section laterally extends to form a protruding portion, and a cutting surface is provided on the protruding portion and configured to be in contact with an inner wall surface of the elastic portion.

16. The electrical connector according to claim 13, wherein the elastic portion is inclined toward a direction close to the first grounding portion.

17. The electrical connector according to claim 13, wherein at least one through slot is provided on at least one of the side walls, the through slot has a first slot wall and a second slot wall provided opposite to each other, the elastic portion is connected to the second slot wall and extends toward the first slot wall from the second slot wall, and a free end of the elastic portion is disconnected from the first slot wall.

18. The electrical connector according to claim 17, wherein a metal shell is sleeved on the shielding shell, and the metal shell covers the through slot and the elastic portion.

19. The electrical connector according to claim 13, wherein the shielding sheet comprises a plate body and at least one abutting portion extending from the plate body toward a side thereof, and the abutting portion is exposed from the insulating body and is in rigid contact with the side walls.

20. The electrical connector according to claim 19, wherein the insulating body comprises a base portion, the base portion is provided with a recess portion, and the first grounding portion and the abutting portion are located in the recess portion.

21. The electrical connector according to claim 19, wherein the first grounding portion and the abutting portion are provided on a same side of the insulating body, and a height of the abutting portion is different from a height of the first grounding portion in a vertical direction.

* * * * *